United States Patent [19]

Janke

[11] 4,338,753

[45] Jul. 13, 1982

[54] ARRANGEMENT FOR CONNECTING TWO PROFILE MEMBERS, PARTICULARLY CHANNEL MEMBERS FOR METAL WINDOWS

[75] Inventor: Bernhard Janke, Bindlach, Fed. Rep. of Germany

[73] Assignee: Hef Technische Entwicklung GmbH & Co. KG, Dusseldorf, Fed. Rep. of Germany

[21] Appl. No.: 150,667

[22] Filed: May 16, 1980

[30] Foreign Application Priority Data

May 14, 1979 [DE] Fed. Rep. of Germany ... 7914521[U]

[51] Int. Cl.[3] ..... E04B 1/62; E04B 1/343; G09F 15/00

[52] U.S. Cl. ..... 52/309.13; 52/586; 52/398; 52/417; 52/438

[58] Field of Search ..... 52/309.13, 586, 398, 52/417, 438, 24; 428/103; 49/DIG. 1

[56] References Cited

U.S. PATENT DOCUMENTS

| | | | |
|---|---|---|---|
| 3,191,727 | 6/1975 | Schmeltz | 49/DIG. 1 |
| 3,680,530 | 8/1972 | Drawsky | 52/586 |
| 3,862,523 | 1/1975 | Eaton | 52/586 |
| 3,918,233 | 11/1975 | Simpson | 52/81 |
| 4,115,972 | 9/1978 | Varlonga | 49/DIG. 1 |

*Primary Examiner*—Reinaldo P. Machado

[57] ABSTRACT

Window frame members are joined by an arrangement comprising a pair of frame strip members having in cross section a U-shaped receptor. Each of the arms of the receptor have laterally inwardly directed projections. A connecting strip is provided having in cross section a central portion and a catch lug at each end for entry within the receptor. The catch lug is provided with outwardly directed projections on each of its lateral sides which cooperate with the inner edge of the inwardly directed projections on the receptor. The catch lug and the receptor are formed so that a cavity is defined within the receptor, which cavity can be filled with a hardenable filler.

7 Claims, 2 Drawing Figures

Figure 1:
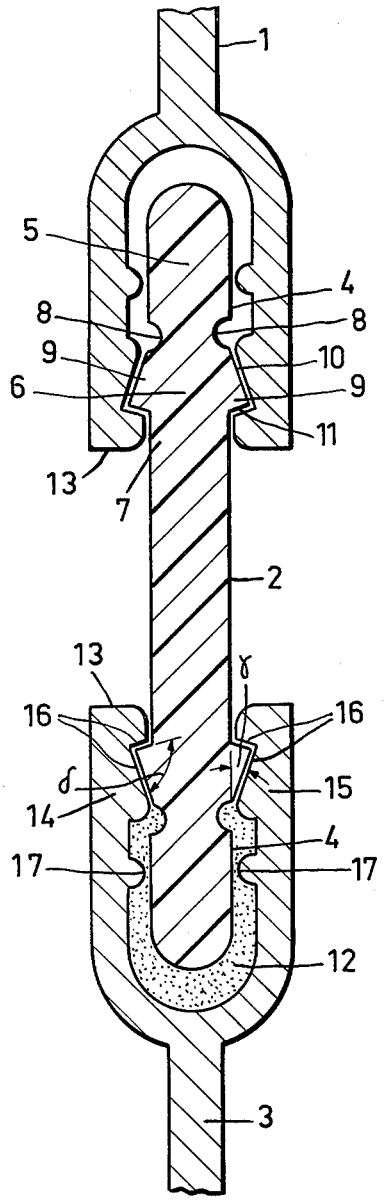

ARRANGEMENT FOR CONNECTING TWO PROFILE MEMBERS, PARTICULARLY CHANNEL MEMBERS FOR METAL WINDOWS

BACKGROUND OF THE INVENTION

The invention relates to an arrangement for joining two sectional parts, in particular frame parts of metal windows, with at least one connecting strip of plastic or similar heat-insulating material which comprises strip type catch lugs which are received in a U-piece of a sectional part and are fixed by lateral projections engaging in corresponding undercuts of the U-pieces.

In a known insulating section (Swiss Pat. No. 411,290), the catch lugs comprise a unilateral wedge-shaped projection whose length corresponds to the hollow-form depth of the U-pieces receiving them. Exact dimensions of the catch lugs are therefore a prerequisite for secure locking. Besides the catch lugs, the connecting strips in the known arrangement comprise abutment faces which determine the distance of the connected sectional parts. From this, too, special requirements exist for accurately sizing the connecting strips; being that plastic parts are involved, it is difficult to maintain narrow manufacturing tolerances.

In another known insulating section (German Utility Model No. 7522 009) the plastic connecting strips do not have the mentioned abutment faces; but the catch lugs extend here, too, over the entire depth of the cavity of the U-pieces. The catch lugs are divided the cut into two lobes with lateral cuts which snap into corresponding projections of the U-pieces receiving them. As the expansion effect of the catch lugs is slight, rods are subsequently driven into the cuts to ensure a safe hold of the connecting strips.

In contradistinction, it is the object of the present invention to improve the known arrangements for the joining of two sectional parts in twofold respect; for one thing, the requirements for accuracy of dimensions are to be substantially reduced and for another, a secure snapping in and firm hold of the catch lugs in the interior of the U-pieces receiving them are to be achieved.

SUMMARY OF THE INVENTION

This problem is solved according to the invention in providing a profile depth of the U-pieces greater than the height of the catch lugs. The catch lugs are provided with projections on opposite sides and are connected with the connecting strip through a web portion guided in the region of the profile depth only laterally in the respective U-piece; and the U-pieces are formed by two sectional legs with free spring action.

Due to the proposal according to the invention, the only dimension still subject to tolerances is the distance between the sectional parts, which is determined by the distance between the two projections of opposite catch lugs. Otherwise the requirements for accuracy of dimensions, in particular with respect to the form of the catch lugs themselves, are low, i.e. they are within the usual manufacturing tolerances for plastic injection molded or extruded parts. Additional measures for securing the neck of the catch lugs in the interior of the U-pieces are not absolutely necessary; it is, however, desirable to fill the remaining cavity between the catch lugs and the inner form of the U-pieces with a liquid or pasty hardening filler material, preferably a hardening adhesive.

For the snapping in of the catch lugs in the interior of the U-pieces the springy design of the sectional legs forming the U-pieces is essential. In contrast to the known arrangements, special spring characteristics or deformation properties on the part of the connecting strip no longer matter. The connecting strip consists preferably of a heat-insulating, form-stable, limitedly flexible plastic. The optional parts, instead, consist of metal or metal alloy, preferably light metal.

In a preferred embodiment the catch lugs, viewed in cross section, terminate in a head portion, which is provided with a contiguous lock portion with the lateral projections and then the web portion, so that the projections are defined by a side wall starting from the head portion and inclined obliquely outward at a pitch angle of 15°–30° to the longitudinal axis of the catch lug and by a lock wall inclined crosswise to the longitudinal axis and connecting the side wall with the web portion. The wedge angle is preferably 20° to 35°, the angle enclosed between side wall and lock wall is about 90°, preferably up to about 10° smaller than 90°. By the chosen wedge angle it is assured that the projections of the lock portion engage completely in the corresponding undercuts of the U-pieces, in such a way that the lock wall of the projections make contact under the lateral spring pressure of the U-section legs, whereby the mutual distance of the sectional parts is ensured.

To prevent the projections of the lock portion from entering two deeply into the U-piece and thus getting behind the corresponding undercuts of the interior of the U-pieces, there is provided according to the invention a difference between the profile depth of the U-pieces and the height of the catch lugs smaller than the length-measured in the direction of their longitudinal axis of the undercuts of the U-pieces in which the projections are received.

In order to achieve, when using a filler material in the interior of the U-pieces, a complete filling of the available cavity by the filler material and at the same time an optimum keying of the parts to be connected by the hardened filler material, it is provided according to the present invention that, on opposite sides of the catch lugs, a trough-shaped depression is provided between the head portion and the lock portion and further that the cavity surrounding the head portion of the catch lugs of the U-pieces is wider and deeper with respect to its cross-sectional dimensions than the head portion and is narrowed on both sides at mid-height of the head portion by guide beads extending longitudinally of the profile.

If the filler composition is filled into the U-pieces before the connecting strips are introduced, the filler composition is displaced by the head portion against the direction of introduction, and in so doing it fills the cavity between the guide beads and the trough-shaped depressions of the head portion.

In the following, two embodiments of the invention are explained with reference to the drawing.

Figure 2:
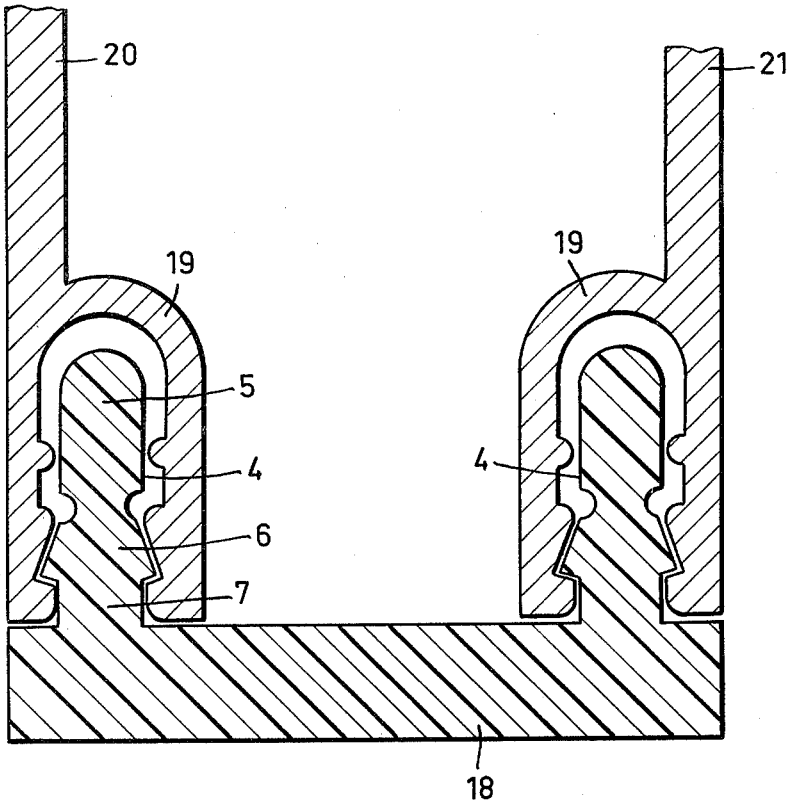

FIG. 1 shows a transverse section through a flat connecting strip with U-pieces of the interconnected sectional parts, and FIG. 2, a transverse section through a connecting strip with lateral catch lugs and associated U-sections of the connected sectional parts.

DESCRIPTION OF THE INVENTION

A sectional part 1 e.g. of an outer frame section of a metal window is joined by means of a connecting strip 2 of plastic to a sectional part 3 e.g. the inner frame portion of a metal window, the connecting strip 2 serving as heat insulation. On the opposite edges of the connecting strip 2 are formed strip type catch lugs 4, each comprising a head portion 5, a lock portion 6 and a web portion 7. The head portion 5 and lock portion 6 are separated from each other by a trough type depression 8 formed on each side of the strip. On each side of portion 6 projections 9 are formed, which are defined toward the outside by an oblique side wall 10 and extending from it toward the web portion 7 by a lock wall 11.

The wedge angle gamma between a side wall 10 and a line parallel to the longitudinal axis L of the catch lug is about 20° to 25°. The angle delta enclosed between the side wall 10 and lock wall 11 is a little less than 90°. To simplify the drawing, the filling of the cavity 12 of the corresponding U-piece 13 by a hardenable filling composition has been marked only for the lower sectional part 3 by dotting. The legs 14, 15 of the metal U-pieces 13 have on their inner side a depression 16, in which are received the lateral projections 9 of the lock portions 6 of the catch lugs 4. In additon, the legs 14, 15 of the U-pieces 13 have on their inside projecting guide beads 17. These serve to guide the head portion 5 of the catch lugs 4 on being introduced into the interior of the respective U-piece 13 and form with the head portion 5 thereof a nozzle type constriction through which previously filled filler material is displaced to the outside, so that complete filling of the remaining cavity 12 with filler composition is assured.

FIG. 2 shows, again in transverse section, a connecting piece 18 which has on one side two catch lugs 4 identical with the catch lugs described for FIG. 1; the same is true of the inner form of the U-piece 19, which, however, at variance with FIG. 1, are unilaterally attached to sectional parts 20, 21. The spring effect of the profile legs forming the U-pieces 19 is not impaired thereby.

To the described embodiments, of course, numerous additional variants are conceivable; for example, in the embodiment of FIG. 2, the arrangement of symmetrical catch lugs on the opposite side of the connecting strip 18.

I claim:

1. An arrangement for joining window frame members and the like, comprising a pair of frame strip members having in cross section a U-shaped receptor each of the arms of which having laterally inwardly directed projections, a connecting strip having in cross section a central portion and a catch lug at each end for entry within the receptor of an associated frame strip member, said catch lug being provided with outwardly directed projections on each of its lateral sides for cooperation with the inner edge of laterally inwardly directed projections of the associated receptor, a head portion, and a recess on each of its lateral sides between said outwardly directed projection and the head portion, said catch lug having a height less than the depth of said receptor, the cavity defined by said receptor and catch lug being adapted to receive a hardenable filler material whereby said strip frame members and said connecting strips are held securely.

2. The arrangement according to claim 1 wherein the arms of said receptor have a free spring action to snap over said outwardly directed projections.

3. The arrangement according to claim 1 wherein the outwardly directed projections are defined by a side wall starting from the head portion and inclined obliquely outward under a wedge angle of 15°–30° to the longitudinal axis of the catch lug and by a lock wall inclined transverse to the longitudinal axis and connecting the side wall with the central strip.

4. The arrangement according to claim 3 wherein the wedge angle is 20°–25°.

5. The arrangement according to claim 3 wherein the angle enclosed by the side wall and the lock wall is between 80° to 90°.

6. The arrangement according to claim 1 wherein said inwardly directed projections are formed by undercuts in the inner walls of said receptors and the difference between the depth of the receptor and the height of the catch lugs is smaller than the length measured in the direction of the longitudinal axis of the undercuts.

7. The arrangement according to one of claims 1–6, wherein the cavity defined by said receptor and said catch lugs is wider and deeper with respect to its cross-sectional dimensions than the head portion of said catch lug, said cavity being narrowed on both sides at mid-height of the head portion by guide beads.

* * * * *